US009121291B2

(12) United States Patent
Hada

(10) Patent No.: US 9,121,291 B2
(45) Date of Patent: Sep. 1, 2015

(54) TURBINE BLADE AND GAS TURBINE

(75) Inventor: Satoshi Hada, Tokyo (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 807 days.

(21) Appl. No.: 13/307,854

(22) Filed: Nov. 30, 2011

(65) Prior Publication Data

US 2012/0230838 A1 Sep. 13, 2012

(30) Foreign Application Priority Data

Mar. 11, 2011 (JP) ..... 2011-053779

(51) Int. Cl.
*F01D 5/18* (2006.01)

(52) U.S. Cl.
CPC ..... *F01D 5/187* (2013.01); *F01D 5/188* (2013.01); *F01D 5/189* (2013.01); *F05D 2250/185* (2013.01); *F05D 2260/606* (2013.01)

(58) Field of Classification Search
CPC ..... F01D 5/18; F01D 5/181; F01D 5/187; F01D 5/188; F01D 5/189; F05D 2240/81; F05D 2260/20; F05D 2250/185; F05D 2260/606
USPC ..... 415/115; 416/95, 96 R, 97 R, 193 R, 416/193 A
See application file for complete search history.

(56) References Cited

U.S. PATENT DOCUMENTS 4,684,322 A * 8/1987 Clifford et al. ..... 416/95
4,753,575 A 6/1988 Levengood et al.
5,387,086 A * 2/1995 Frey et al. ..... 416/97 R
5,873,695 A * 2/1999 Takeishi et al. ..... 415/115
5,915,923 A 6/1999 Tomita et al.
6,092,991 A * 7/2000 Tomita et al. ..... 416/96 R
6,132,173 A 10/2000 Tomita et al.
6,139,269 A * 10/2000 Liang ..... 416/97 R
6,382,914 B1 * 5/2002 Tressler ..... 416/97 R
6,491,496 B2 * 12/2002 Starkweather ..... 416/97 R (Continued)

FOREIGN PATENT DOCUMENTS

EP 0866214 A2 9/1998
EP 1688587 A2 8/2006

(Continued)

OTHER PUBLICATIONS

A Decision to Grant a Patent has been received dated May 7, 2014, issued in corresponding Japanese Patent Application No. 2013-504514 (3 pages).

(Continued)

*Primary Examiner* — Nathaniel Wiehe
*Assistant Examiner* — Kayla McCaffrey
(74) *Attorney, Agent, or Firm* — Westerman, Hattori, Daniels & Adrian, LLP

(57) ABSTRACT

Provided is a turbine blade including: a platform; a blade body including a cooling flow channel including a meandering serpentine cooling flow channel; a fillet portion provided in a joint surface between the blade body and the platform; and a base portion including a cooling flow channel communicated with the serpentine cooling flow channel. The cooling flow channel includes a bypass flow channel that is branched off from a high-pressure part of the cooling flow channel, passes through along the inside of the fillet portion, and is connected to a low-pressure part of the cooling flow channel.

9 Claims, 10 Drawing Sheets

A – A

(56) References Cited

U.S. PATENT DOCUMENTS

| | | | | |
|---|---|---|---|---|
| 7,704,046 | B1 | 4/2010 | Liang | |
| 8,454,301 | B1 * | 6/2013 | Liang | 415/116 |
| 2008/0166240 | A1 | 7/2008 | Scott et al. | |
| 2009/0324423 | A1 | 12/2009 | Liang | |
| 2010/0040480 | A1 | 2/2010 | Webster et al. | |

FOREIGN PATENT DOCUMENTS

| | | | |
|---|---|---|---|
| EP | 2037081 | A1 | 3/2009 |
| JP | 08-505195 | A | 6/1996 |
| JP | 11-166401 | A | 6/1999 |
| JP | 2006-83859 | A | 3/2006 |
| JP | 2006-112429 | A | 4/2006 |
| JP | 2006-170198 | A | 6/2006 |
| JP | 2007-224919 | A | 9/2007 |
| WO | 94/12770 | A1 | 6/1994 |

OTHER PUBLICATIONS

International Search Report of PCT/JP2011/077472, date of mailing Dec. 27, 2011.

Korean Notice of Allowance dated Aug. 27, 2014, issued in corresponding KR application No. 10-2013-7002450 (2 pages).

Notification of Reasons for Rejection dated Jan. 6, 2015, issued in corresponding Japanese Application No. 2014-012586, w/English translation. (6 pages).

Office Action dated Jan. 26, 2015, issued in corresponding Chinese Application No. 201180038865.1. (6 pages).

Decision to Grant a Patent dated Mar. 31, 2015, issued in a corresponding divisional Japanese Patent Application No. 2014-012586, "The Decision to Grant a Patent has been received" (3 pages).

* cited by examiner

A — A

B－B

C – C

D — D

TURBINE BLADE AND GAS TURBINE

CROSS-REFERENCE TO RELATED APPLICATIONS

This application is based on Japanese Patent Application No. 2011-053779, the contents of which are incorporated herein by reference.

TECHNICAL FIELD

The present invention relates to a turbine blade applied to a gas turbine and to a gas turbine.

BACKGROUND ART

A gas turbine is an apparatus that converts thermal energy of high-temperature combustion gas into rotational energy and takes out the converted energy as electric power, and turbine blades incorporated in the gas turbine are always used in the high-temperature combustion gas. Accordingly, the turbine blades each include a cooling flow channel such as a serpentine flow channel, and take in cooling air from the outside to thereby cool a blade body thereof. In particular, a fillet portion forming a joint surface between the blade body and the platform of each turbine blade has a thick wall and thus is difficult to cool. Hence, the wall temperature of the fillet portion is relatively high, and the fillet portion tends to be subjected a thermal stress, in terms of a thermal load and a blade structure. In order to solve this problem, various methods of cooling the fillet portion by convection with cooling air have been proposed as means for cooling the fillet portion of the turbine blade.

Japanese Unexamined Patent Application, Publication No. 2006-112429 discloses the following solution. Cooling air is introduced into a cavity provided in a blade body near a fillet portion, through a cooling flow channel from a base portion (blade root) side, the fillet portion is cooled by convection from the inside thereof, and the cooling air is discharged into combustion gas from a film cooling hole provided in the cavity.

Japanese Unexamined Patent Application, Publication No. 2006-170198 discloses the following solution. A branch pipe for cooling air is drawn from a cooling air supply channel provided in a base portion, a film cooling hole is opened so as to pass through a fillet portion, and the cooling air is blown out from the film cooling hole, to thereby cool the fillet portion.

CITATION LIST

Patent Literature

{PTL 1} Japanese Unexamined Patent Application, Publication No. 2006-112429

{PTL 2} Japanese Unexamined Patent Application, Publication No. 2006-170198

SUMMARY OF INVENTION

Technical Problem

Unfortunately, a high thermal stress is generally applied near the fillet portion and to the outer surface of the platform on which a large thermal load is put. Hence, there is a possibility that the fatigue crack easily occurs due to stress concentration around a hole, resulting in the problem in a cooling hole.

The present invention has been made in view of the above-mentioned problem, and therefore has an object to provide a cooling structure for a turbine blade, the cooling structure being capable of eliminating the need to form a hole on a blade surface and a platform outer surface to which a high thermal stress is applied, and effectively utilizing cooling air that has cooled a fillet portion by convection, as cooling air for the inside of a blade body without discharging the cooling air into combustion gas from a cooling hole near the fillet portion.

Solution to Problem

In order to solve the above-mentioned problem, the present invention adopts the following solutions.

A turbine blade according to a first aspect of the present invention includes: a platform; a blade body including a cooling flow channel including a meandering serpentine cooling flow channel; a fillet portion provided in a joint surface between the blade body and the platform; and a base portion including a cooling flow channel communicated with the serpentine cooling flow channel. The cooling flow channel includes a bypass flow channel that is branched off from a high-pressure part of the cooling flow channel, is provided inside of the fillet portion so as to run along the fillet portion, and is connected to a low-pressure part of the cooling flow channel.

According to the first aspect, the bypass flow channel is branched off from the high-pressure part of the cooling flow channel, in which the cooling air pressure is high, is provided inside of the fillet portion so as to run along the fillet portion, and is connected to the low-pressure part of the cooling flow channel, in which the cooling air pressure is low. Hence, part of the cooling air can be caused to flow into the bypass flow channel by utilizing a difference in pressure of the cooling air between the high-pressure part and the low-pressure part. With this configuration, the fillet portion can be cooled from the inside thereof by convection with the cooling air flowing through the bypass flow channel, and hence it is not necessary to provide a cooling hole near the fillet portion or in the platform surface. Accordingly, a possibility that the fatigue crack and other such problems of the blade due to stress concentration around the cooling hole can be avoided, leading to enhanced reliability of the blade. In addition, the cooling air flowing through the bypass flow channel is returned to the low-pressure part of the cooling flow channel, and cools by convection the inside of the blade body while flowing through the cooling flow channel and being discharged into combustion gas. Hence, the cooling air can be used for several occasions, leading to a reduction in the amount of cooling air.

It is desirable that the cooling flow channel according to the first aspect include the bypass flow channel having: an entrance provided in a portion of the fillet portion of the high-pressure part; and an exit provided in the fillet portion of the low-pressure part.

It is desirable that the cooling flow channel according to the first aspect includes the bypass flow channel having: an entrance provided on an inner side in a radial direction from the fillet portion of the high-pressure part; and an exit provided on an outer side in the radial direction from the fillet portion of the low-pressure part.

It is desirable that the cooling flow channel according to the first aspect includes the bypass flow channel having: an entrance provided on an outer side in a radial direction from the fillet portion corresponding to the high-pressure part; and an exit provided on an inner side in the radial direction from the fillet portion of the low-pressure part.

It is desirable that the cooling flow channel according to the first aspect include cooling flow channels in a plurality of flow systems and that the high-pressure part and the low-pressure part be provided in cooling flow channels in different flow systems.

It is desirable that the cooling flow channel according to the first aspect include cooling flow channels in a plurality of flow systems and that the high-pressure part and the low-pressure part be provided in a cooling flow channel in the same flow system.

It is desirable that the cooling flow channel according to the first aspect include the bypass flow channel be provided in at least one of a pressure side and a negative pressure side of the blade body.

It is desirable that: the cooling flow channel of the blade body according to the first aspect include cooling flow channels in three flow systems; the first-system cooling flow channel be formed of a first cooling flow channel located closest to a leading edge; the second-system cooling flow channel be formed of a serpentine cooling flow channel including a second cooling flow channel, a third cooling flow channel, and a fourth cooling flow channel that are arranged in the stated order from the leading edge toward a trailing edge, the second cooling flow channel being located close to the first cooling flow channel; the third-system cooling flow channel be formed of a serpentine cooling flow channel including a fifth cooling flow channel, a sixth cooling flow channel, and a seventh cooling flow channel that are arranged in the stated order from the leading edge toward the trailing edge, the fifth cooling flow channel being located close to the fourth cooling flow channel; the high-pressure part be provided in the first cooling flow channel; and the low-pressure part be provided in the second cooling flow channel.

It is desirable that a gas turbine according to a second aspect of the present invention include the above-mentioned turbine blade.

Advantageous Effects of Invention

According to the present invention, the turbine blade includes the bypass flow channel that is branched off from the high-pressure part of the cooling flow channel, is provided inside of the fillet portion so as to run along the fillet portion, and is returned to the low-pressure part of the cooling flow channel, and hence the fillet portion can be cooled by convection from the inside thereof. Accordingly, the fillet portion can be cooled without forming a cooling hole on the outer surface near the fillet portion or the outer surface of the platform to which a high thermal stress is applied, and hence fatigue crack and other such problems of the blade can be avoided, leading to enhanced reliability of the blade.

DESCRIPTION OF EMBODIMENTS

Hereinafter, embodiments of a turbine blade and a gas turbine according to the present invention are described with reference to FIG. 1 to FIG. 6.

FIRST EXAMPLE

Figure 1:
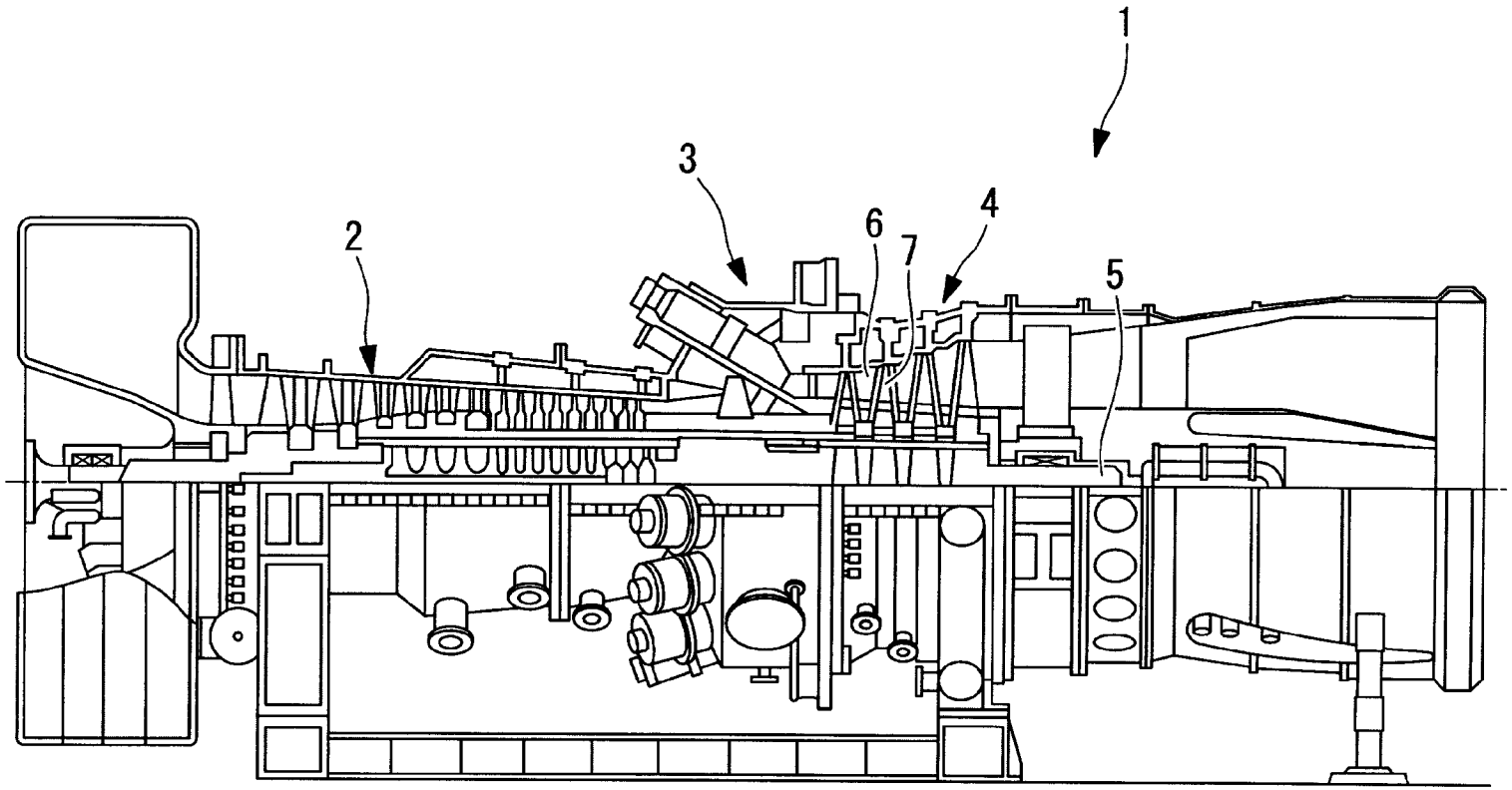
FIG. 1 illustrates an example overall configuration view of a gas turbine.
Figure 2:
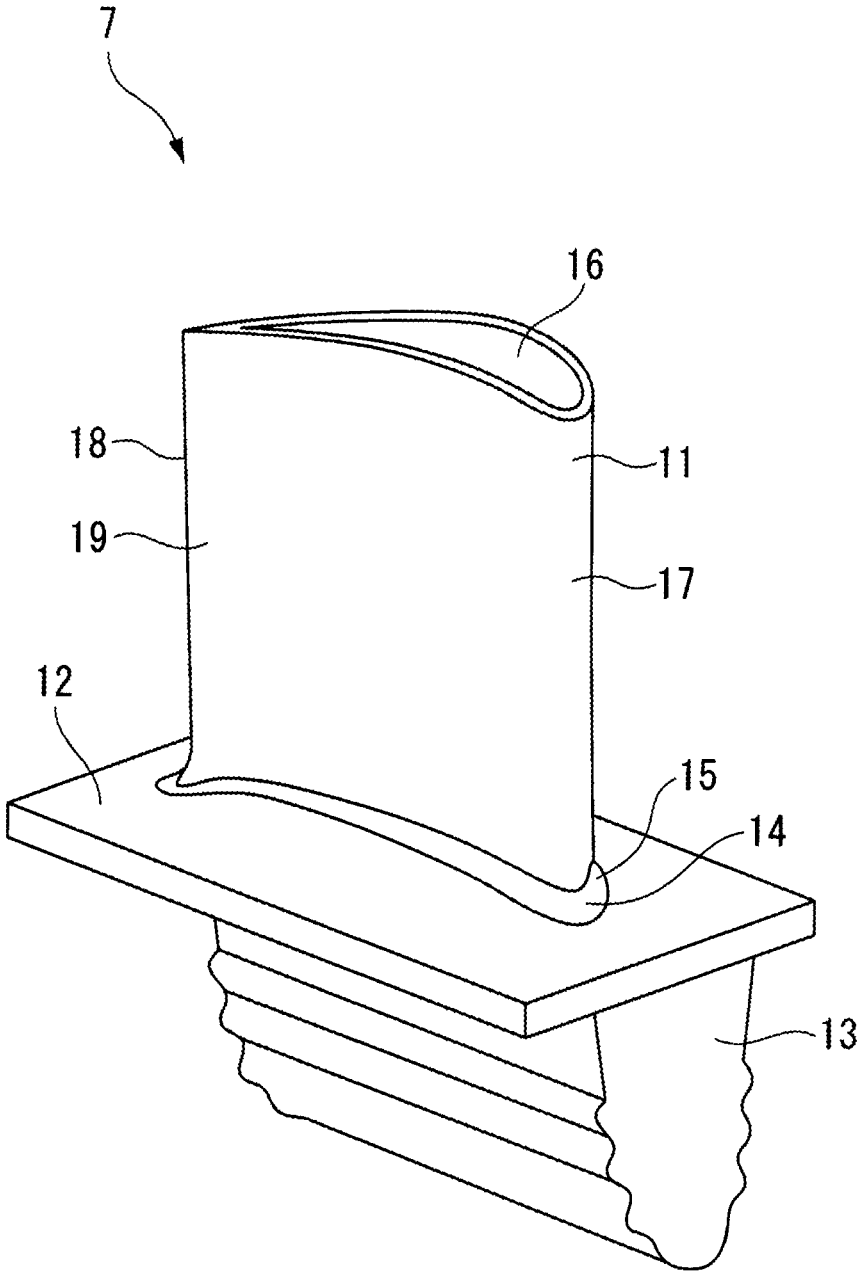
FIG. 2 illustrates a perspective view of a turbine blade.

With reference to FIG. 1 to FIG. 3, a first example is described below.

FIG. 1 illustrates an overall configuration view of a gas turbine. A gas turbine 1 includes: a compressor 2 that compresses combustion air; a combustor 3 that combusts the compressed air fed from the compressor 2 by jetting a fuel thereto and generates combustion gas; a turbine unit 4 that is provided on the downstream side in the flow direction of the combustion gas fed from the combustor 3 and is driven with the combustion gas fed from the combustor 3; and a rotor 5 that integrally fastens the compressor 2, the turbine unit 4, and a power generator (not illustrated).

The turbine unit 4 supplies the combustion gas generated by the combustor 3 to turbine vanes 6 and turbine blades 7, and the turbine blades 7 are rotated around the rotor 5, whereby rotational energy is converted into electric power. The turbine vanes 6 and the turbine blades 7 are alternately arranged from the upstream side to the downstream side in the flow direction of the combustion gas. In addition, the turbine blades 7 are provided in the circumferential direction of the rotor 5, and are rotated integrally with the rotor 5.

FIG. 2 illustrates an external view of the turbine blade. Each turbine blade 7 includes: a blade body 11 that extends in the radial direction and includes a meandering cooling flow channel; a platform 12 that is provided so as to be orthogonal to the blade body 11; and a base portion 13 that fixes the blade body 11 and the platform 12 to the rotor 5. The blade body 11, the platform 12, and the base portion 13 are integrally formed by molding. A fillet portion 14 forming the joint surface between the platform 12 and the blade body 11 is formed in the entire periphery of the blade body so as to have a smoothly curved surface having such a given R (radius of curvature) that can avoid stress concentration.

Figure 3A:
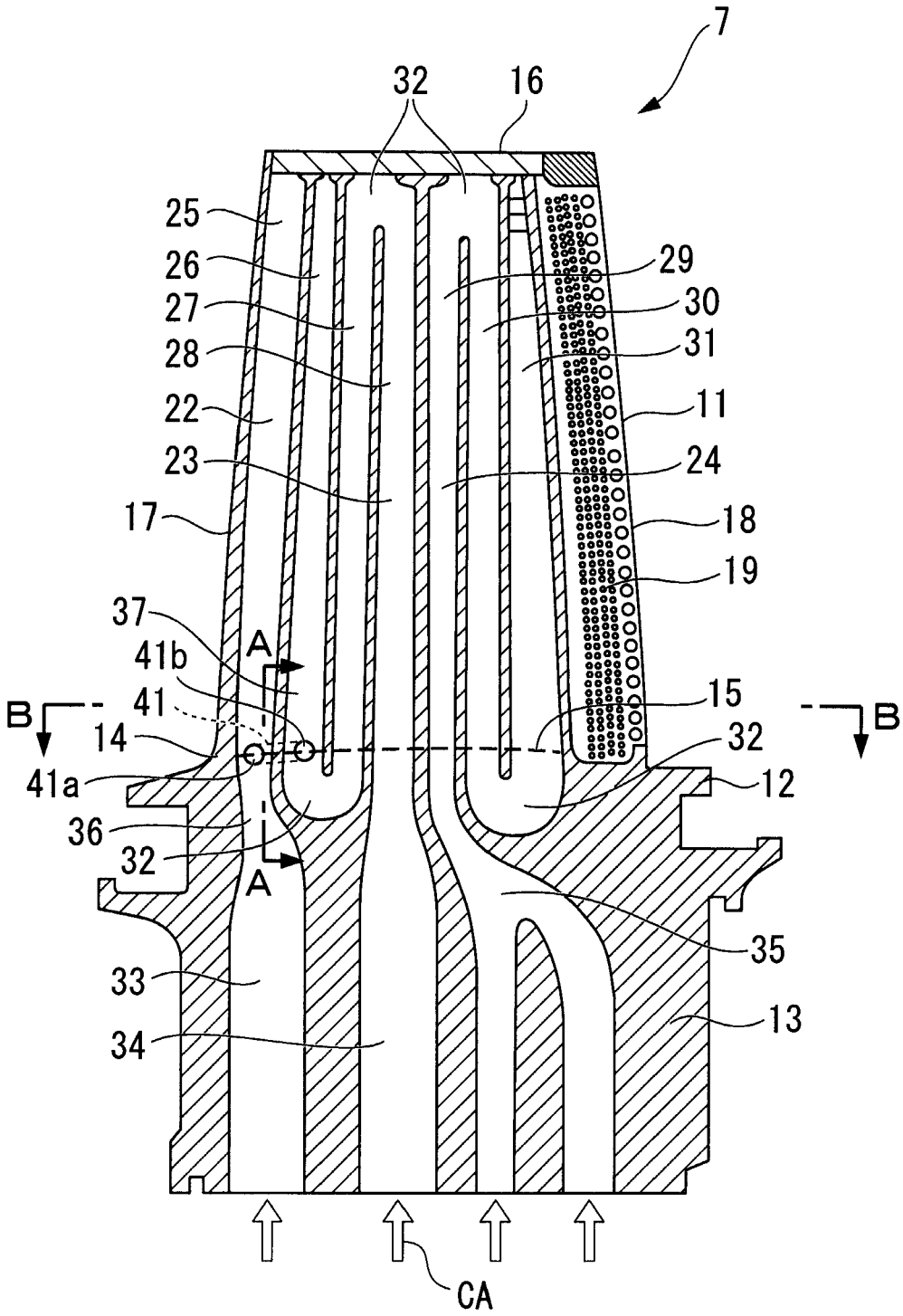
FIG. 3A illustrates a longitudinal sectional view of a turbine blade according to a first example.
Figure 3B:
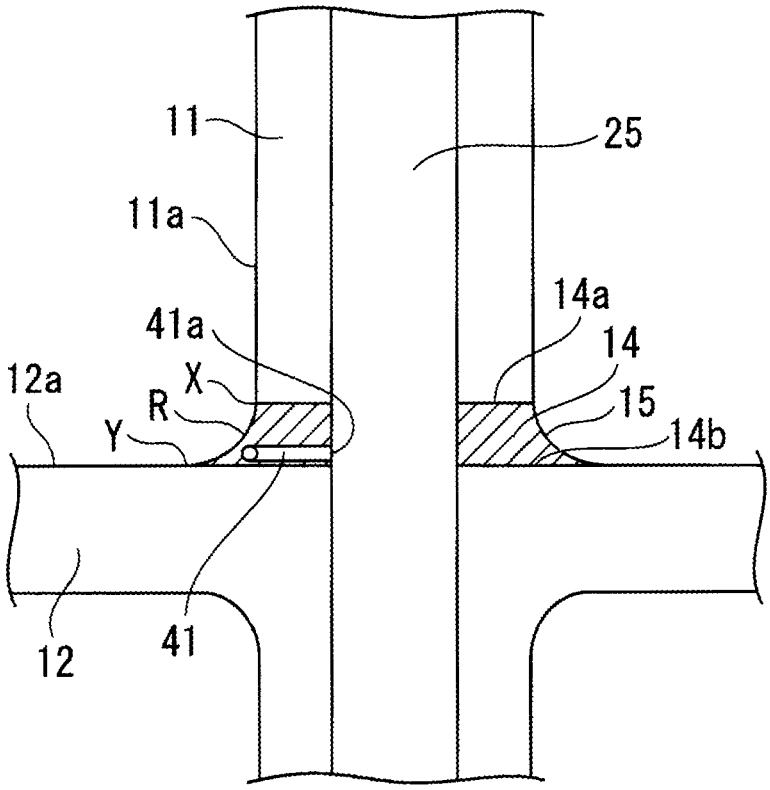
FIG. 3B illustrates a partial longitudinal sectional view (a cross-section A-A of FIG. 3A), which is observed from a leading edge of the turbine blade to a trailing edge thereof.
Figure 3C:
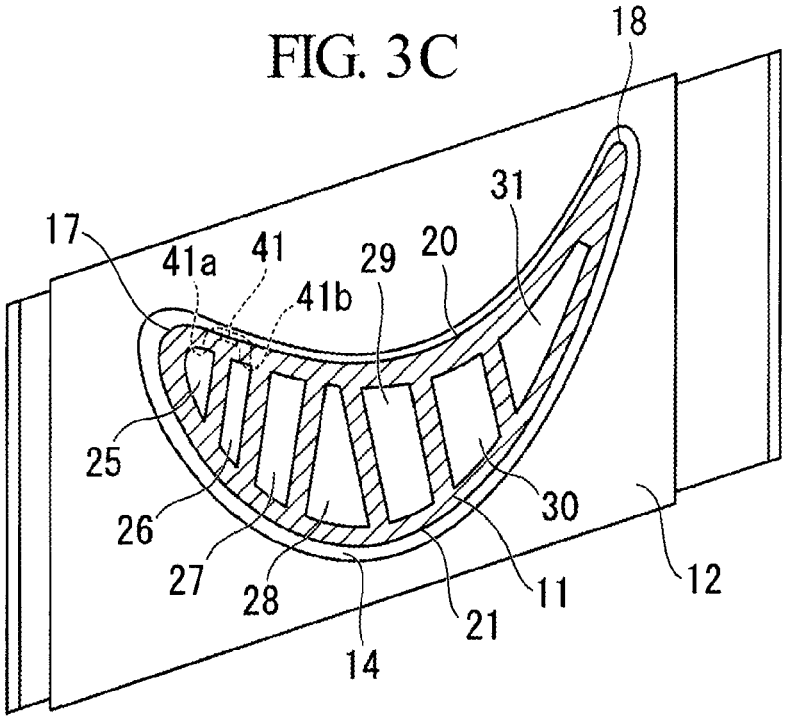
FIG. 3C illustrates a transverse sectional view (a cross-section B-B of FIG. 3A) of the turbine blade.
Figure 3D:
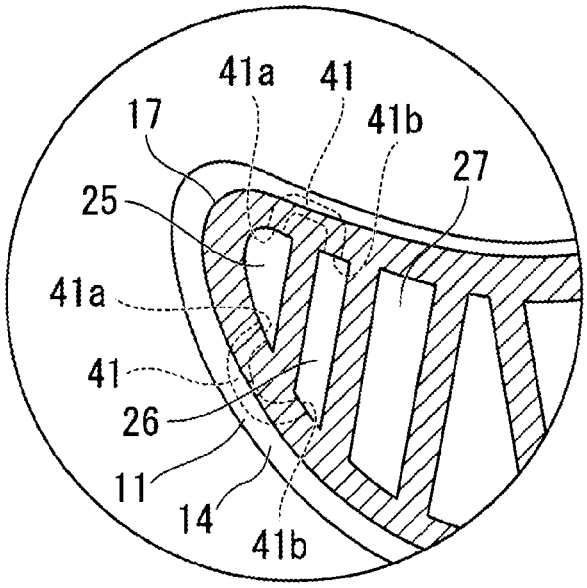
FIG. 3D illustrates a first modified example of a bypass flow channel.

An example cross-sectional structure of the turbine blade is described with reference to FIG. 3A, FIG. 3B, and FIG. 3C. FIG. 3A illustrates a longitudinal sectional view of the turbine blade. FIG. 3B illustrates a partial longitudinal sectional view (a cross-section A-A of FIG. 3A), which is observed from a leading edge 17 of the blade body 11 to a trailing edge 18 thereof. FIG. 3C illustrates a transverse sectional view (a cross-section B-B of FIG. 3A) of the blade body 11. As illustrated in FIG. 3A, cooling flow channels 22, 23, and 24 in a plurality of systems are provided inside of the blade body 11 in order to cool the blade body 11 with cooling air CA. The cooling flow channels of the blade body 11 are communicated with cooling flow channels provided inside of the base portion 13, and the cooling air CA to be caused to flow into the respective cooling flow channels is supplied from cooling flow channels (not illustrated) of the rotor 5 connected to the base portion 13.

The cooling flow channels 22, 23, and 24 of the blade body 11 according to the present example are configured as flow channels in three flow systems, and are respectively communicated with three supply flow channels 33, 34, and 35 that are provided independently from one another inside of the base portion 13 connected to the platform 12.

In the cooling flow channels in three flow systems provided in the blade body 11, the first-system flow channel 22, the second-system flow channel 23, and the third-system flow channel 24 are arranged in the stated order from the leading edge 17 toward the trailing edge 18, that is, the first-system flow channel 22 is located closest to the leading edge 17. The cooling flow channels in the different flow systems are respectively communicated with the first supply flow channel 33, the second supply flow channel 34, and the third supply flow channel 35 that are cooling flow channels provided independently from one another inside of the base portion 13.

The first-system flow channel 22 is located closest to the leading edge 17, is formed of a first cooling flow channel 25 alone running from the base portion 13 side toward a blade top portion 16 in the radial direction, and extends from the base portion 13 to the blade top portion 16. In addition, a large number of film cooling holes (not illustrated) that communicate the combustion gas side with the cooling flow channel side inside of the blade body 11 are provided in portions of a negative pressure side 21 (suction side) and a positive pressure side 20 (pressure side) of the wall surfaces of the blade body 11, the portions being in contact with the first cooling flow channel 25.

The second-system flow channel 23 is provided in an intermediate part between the leading edge 17 and the trailing edge 18 inside of the blade body 11, and is formed of one meandering serpentine cooling flow channel configured by connecting flow channels, that is, a second cooling flow channel 26, a third cooling flow channel 27, and a fourth cooling flow channel 28 to one another through respective fold-back structures (return portions). In the second-system flow channel 23, the second cooling flow channel 26, the third cooling flow channel 27, and the fourth cooling flow channel 28 are arranged in the stated order from the leading edge 17 toward the trailing edge 18, that is, the second cooling flow channel 26 is located closest to the first cooling flow channel 25. The cooling air CA supplied from the rotor 5 side flows into the fourth cooling flow channel 28 through the second supply flow channel 34, and sequentially passes through the third cooling flow channel 27 and then the second cooling flow channel 26 while reversing its flow direction at the respective return portions 32.

That is, the fourth cooling flow channel 28 extends from the base portion 13 side toward the blade top portion 16 in the radial direction, is turned by 180° at corresponding one of the return portions 32 near the blade top portion 16, and is communicated with the third cooling flow channel 27. Similarly, the third cooling flow channel 27 extends from the blade top portion 16 toward the base portion 13 in the radial direction, is turned by 180° at corresponding one of the return portions 32, and is communicated with the second cooling flow channel 26. Further, the second cooling flow channel 26 extends from the base portion 13 side toward the blade top portion 16 in the radial direction, and is communicated with a cooling hole (not illustrated) provided in the blade top portion 16 in the second cooling flow channel 26. Similarly to the first cooling flow channel, a large number of film cooling holes (not illustrated) that communicate the combustion gas side with the respective cooling flow channel sides are provided in portions of the negative pressure side 21 (suction side) and the positive pressure side 20 (pressure side) of the wall surfaces of the blade body 11, the portions being in contact with the second cooling flow channel 26, the third cooling flow channel 27, and the fourth cooling flow channel 28.

The third-system flow channel 24 is provided on the trailing edge 18 side with respect to the intermediate part between the leading edge 17 and the trailing edge 18, and is formed of one meandering serpentine cooling flow channel configured by connecting a fifth cooling flow channel 29, a sixth cooling flow channel 30, and a seventh cooling flow channel 31 to one another through respective fold-back structures (return portions). In the third-system flow channel 24, the fifth cooling flow channel 29, the sixth cooling flow channel 30, and the seventh cooling flow channel 31 are arranged in the stated order from the leading edge 17 toward the trailing edge 18, that is, the fifth cooling flow channel 29 is located closest to the fourth cooling flow channel 28. The cooling air CA flowing out of the seventh cooling flow channel 31 is discharged into the combustion gas from a cooling hole (not illustrated) provided in the blade top portion 16, and part of the cooling air is discharged into the combustion gas from a trailing edge end part 19. Similarly to the second-system flow channel, the cooling air CA supplied from the rotor 5 side flows into the fifth cooling flow channel 29 through the third supply flow channel 35, and sequentially passes through the sixth cooling flow channel 30 and then the seventh cooling flow channel 31 while reversing its flow direction at the respective return portions 32.

That is, the fifth cooling flow channel 29 extends from the base portion 13 toward the blade top portion 16 in the radial direction, is turned by 180° at corresponding one of the return portions 32 near the blade top portion 16, and is communicated with the sixth cooling flow channel 30. Similarly, the sixth cooling flow channel 30 extends from the blade top portion 16 toward the base portion 13 in the radial direction, is turned by 180° at corresponding one of the return portions 32, and is communicated with the seventh cooling flow channel 31. Further, the seventh cooling flow channel 31 extends from the base portion 13 side toward the blade top portion 16 in the radial direction, and is communicated with the cooling hole (not illustrated) provided in the blade top portion 16 and the trailing edge end part 19. Similarly to the cooling flow channels in the other systems, a large number of film cooling holes (not illustrated) that communicate the combustion gas side with the respective cooling flow channel sides are provided in portions of the negative pressure side 21 (suction side) and the positive pressure side 20 (pressure side) of the wall surfaces of the blade body 11, the portions being in contact with the fifth cooling flow channel 29, the sixth cooling flow channel 30, and the seventh cooling flow channel 31.

In addition, a turbulator (not illustrated) may be provided on the inner wall of each cooling flow channel, in order to promote the convection cooling of the blade body.

With such configurations of the cooling flow channels as described above, the cooling air CA supplied from the rotor 5 side to the cooling flow channels (the first supply flow channel 33, the second supply flow channel 34, and the third supply flow channel 35), which are provided in the base portion 13 and are communicated with the respective flow systems, are supplied to the first-system flow channel 22 (the first cooling flow channel 25), the second-system flow channel 23 (the fourth cooling flow channel 28, the third cooling flow channel 27, and the second cooling flow channel 26), and the third-system flow channel 24 (the fifth cooling flow channel 29, the sixth cooling flow channel 30, and the seventh cooling flow channel 31). The cooling air CA supplied to the first-system flow channel 22 cools by convection the inner wall surfaces of the negative pressure side 21 and the positive pressure side 20 of the blade body 11 on the leading edge 17 side, and also film-cools the blade surfaces when being blown out into the combustion gas from the film cooling holes provided in the blade surfaces on the leading edge 17 side. The cooling air CA supplied to the second-system flow channel 23 cools by convection the inner wall surfaces of the negative pressure side 21 and the positive pressure side 20 in the intermediate part of the blade body 11, and also film-cools the blade surfaces when being discharged into the combustion gas from the cooling holes provided in the blade surfaces of the blade body 11. Similarly, the cooling air CA supplied to the third-system flow channel 24 cools by convection the inner wall surfaces of the negative pressure side 21 (suction side) and the positive pressure side 20 (pressure side) of the blade body 11 from the intermediate part of the blade body 11 toward the trailing edge 18, and also film-cools the blade surfaces when being discharged into the combustion gas from the cooling holes provided in the blade surfaces. Further, part of the cooling air CA flowing through the seventh cooling flow channel 31 cools by convection the trailing edge end part 19 when being discharged into the combustion gas from the trailing edge end part 19.

Next, a cooling structure for the fillet portion is described. FIG. 3A, FIG. 3B, and FIG. 3C each illustrate a bypass flow channel 41 that connects the first cooling flow channel 25 to the second cooling flow channel 26. The bypass flow channel 41 is formed inside of the wall of the blade body 11, and the bypass flow channel 41 has: an entrance 41*a* communicated with the first cooling flow channel 25; and an exit 41*b* communicated with the second cooling flow channel 26. That is, in the longitudinal sectional view of the blade body 11 illustrated in FIG. 3A, the bypass flow channel 41 is provided such that both the entrance 41*a* and the exit 41*b* of the bypass flow channel 41 are located within a formation range of the fillet portion 14.

The range of the fillet portion is described below. As illustrated in the partial sectional view of FIG. 3B, the fillet portion 14 is defined as a region surrounded by the curved surface R, the blade body 11, and the platform 12, the curved surface R having such a given radius of curvature that can reduce a thermal stress on the joint part between the blade body 11 and the platform 12, and the fillet portion 14 is formed in the entire periphery of the blade body. Specifically, in the partial sectional view of FIG. 3B, a point is assumed as X at which an outer wall surface 11*a* of the blade body 11, which linearly extends in the radial direction, smoothly intersects with the curved surface R forming the outer surface of the fillet portion 14, and a point is assumed as Y at which a linearly spreading platform outer surface 12*a* of the platform 12 smoothly intersects with the curved surface R. Then, the point X and the point Y are continuously drawn around the blade body 11, whereby a fillet upper end line 14*a* and a fillet lower end line 14*b* are respectively defined along the boundaries between the fillet portion 14 and the outer wall surface 11*a* of the blade body and between the fillet portion 14 and the platform outer surface 12*a*.

A region (a hatched portion in FIG. 3B) surrounded by the fillet upper end line 14*a* and the fillet lower end line 14*b* defines the range of the fillet portion 14.

As illustrated in the partial sectional view of FIG. 3B, the bypass flow channel 41 is provided in the fillet portion 14 surrounded by the fillet upper end line 14*a* and the fillet lower end line 14*b* in sectional view taken from the leading edge to the trailing edge of the blade. That is, the entrance 41*a* of the bypass flow channel 41 is formed in the inner wall surface of the first cooling flow channel 25 within the fillet portion 14, in sectional view taken from the leading edge to the trailing edge of the blade. The bypass flow channel 41 extends from the entrance 41*a* toward the curved surface R in a substantially horizontal direction (rotor axis direction). As illustrated in FIG. 3A and FIG. 3C, the bypass flow channel 41 is provided along the fillet portion 14 inside of the curved surface R of the fillet portion 14 (on the serpentine flow channel side), and is connected to the exit 41b on the second cooling flow channel side. Note that, in the present example, the entirety of the bypass flow channel 41 is provided within the fillet portion 14 surrounded by the fillet upper end line 14*a* and the fillet lower end line 14*b*. Note that the bypass flow channel 41 can be formed together in the course of monoblock casting of the turbine blade. In FIG. 3A, a dotted line 15 illustrates an average height of the fillet portion 14 (an average height between the fillet upper end line 14*a* and the fillet lower end line 14*b* in FIG. 3B).

Next, technical significance of the bypass flow channel is described.

In general, a serpentine flow channel includes a long-distance flow channel that is elongated and meandering, and includes fold-back structures (return portions), a turbulator, and other such internal structures in the middle of the flow channel, and hence the pressure of the cooling air decreases due to pressure loss while the cooling air flows through the flow channel. Note that the pressures of the cooling air CA inside of the first supply flow channel 33, the second supply flow channel 34, and the third supply flow channel 35 that are provided inside of the base portion 13 and take in the cooling air CA from the rotor 5 side are substantially the same as one another.

As illustrated in FIG. 3A and FIG. 3C, the cooling flow channel (the first cooling flow channel 25) of the first-system flow channel 22 is configured as a single flow channel that is located closest to the leading edge 17 and extends from the base portion 13 side to the blade top portion 16. The pressure of the cooling air CA is highest in a portion on the base portion 13 side of the first cooling flow channel 25, the portion taking in the cooling air CA from the rotor 5 side. A high-pressure part 36 is formed in a region inside of the flow channel near the fillet portion 14, the region including both portions on the inner side and the outer side in the radial direction with respect to the fillet portion 14.

Further, the second-system flow channel 23 is formed of a long meandering serpentine cooling flow channel configured by connecting the second cooling flow channel 26, the third cooling flow channel 27, and the fourth cooling flow channel 28 to one another through the fold-back structures (return portions). The pressure of the cooling air CA is highest on the upstream side of the fourth cooling flow channel 28 that takes in the cooling air CA from the rotor 5 side. The cooling air pressure gradually decreases due to pressure loss while the cooling air flows through the cooling flow channels and the return portions, and the cooling air pressure becomes substantially the same as the combustion gas pressure immediately after the cooling air is discharged from the cooling hole (not illustrated) of the blade body in the second cooling flow channel 26. That is, the cooling air pressure decreases while the cooling air CA flows through the fourth cooling flow channel 28, the third cooling flow channel 27, and the second cooling flow channel 26 in the stated order, and hence the cooling air pressure is lowest at the downstream end (at the blade top portion 16) of the second cooling flow channel 26. In an area leading to the blade body 11 from the base portion 13 side of the fourth cooling flow channel 28, a high-pressure part 36 is formed in a region near the fillet portion 14, the region including both portions on the inner side and the outer side in the radial direction with respect to the fillet portion 14. A low-pressure part 37 is formed in a region near the fillet portion 14 in the second cooling flow channel 26.

With this configuration, part of the cooling air can be branched to flow into the bypass flow channel 41 by utilizing a difference in pressure of the cooling air between the high-pressure part 36 on the entrance 41*a* side of the bypass flow channel and the low-pressure part 37 on the exit 41*b* side thereof, and the fillet portion 14 can be cooled by convection with the cooling air CA flowing through the bypass flow channel, from the inside of the blade body 11.

In addition, the bypass flow channel may be provided in one of the negative pressure side 21 (suction side) and the positive pressure side 20 (pressure side) of the blade body 11, or may be provided in both the sides. It is desirable to select one side or both the sides, depending on the blade structure and how a thermal load is put on the blade surfaces. In the first example illustrated in FIG. 3C, the bypass flow channel 41 is provided only in the positive pressure side 20 of the blade body 11 on the leading edge 17 side, but the bypass flow channel 41 may be provided only in the negative pressure side 21, depending on the state of a thermal stress. Further, in a first modified example illustrated in FIG. 3D, the bypass flow channel 41 is provided in both the positive pressure side 20 and the negative pressure side 21.

According to the configuration described in the first example, the bypass flow channel is provided near the fillet portion, and hence the fillet portion can be cooled by convection from the inside thereof. This eliminates the need to perform hole processing, such as forming a cooling hole, on the blade surface near the fillet portion or the platform surface to which a high thermal stress is applied, and hence the possibility of the fatigue crack and other such problems of the blade can be avoided, leading to enhanced reliability of the blade.

Further, the cooling air is returned to the serpentine flow channel without being discharged into the combustion gas from the cooling hole near the fillet portion, and hence the cooling air returned to the second cooling flow channel 26 further cools the blade body 11 by convection while flowing through the second cooling flow channel 26. Furthermore, the cooling air is blown out from the film cooling holes to film-cool the blade surfaces, and hence the cooling air can be used for several occasions, leading to a reduction in the amount of cooling air. Accordingly, the thermal efficiency of the entire gas turbine and the reliability of the gas turbine can be enhanced.

Figure 4A:
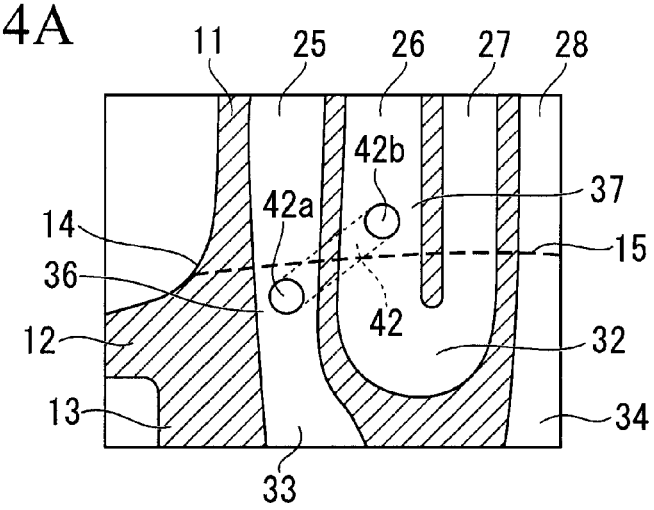
FIG. 4A illustrates a second modified example of the bypass flow channel.
Figure 4B:
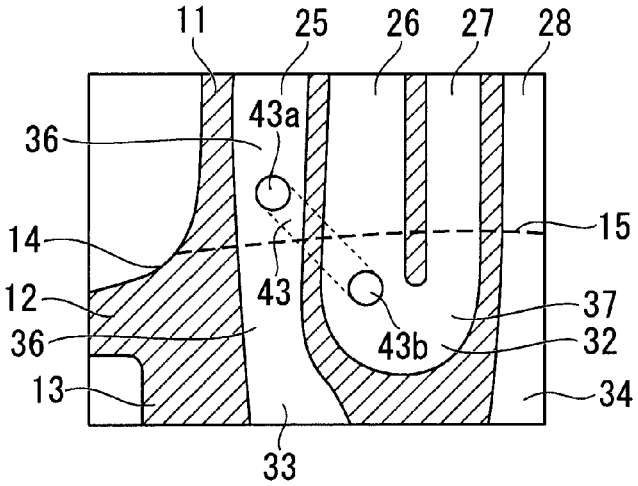
FIG. 4B illustrates a third modified example of the bypass flow channel.
Figure 4C:
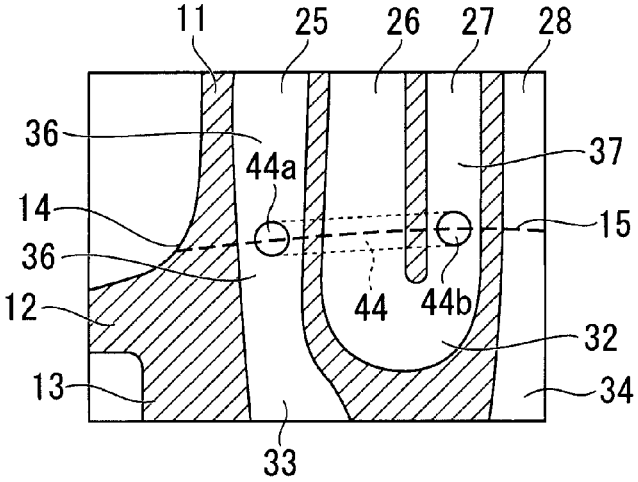
FIG. 4C illustrates a fourth modified example of the bypass flow channel.

FIG. 4A, FIG. 4B, and FIG. 4C each illustrate a modified example of the first example concerning the bypass flow channel. In a second modified example illustrated in FIG. 4A, the high-pressure part 36 is provided on the inner side in the radial direction from the fillet portion 14 inside of the first cooling flow channel 25, and the low-pressure part 37 is provided on the outer side in the radial direction from the fillet portion 14 inside of the second cooling flow channel 26. Then, an entrance 42*a* of a bypass flow channel 42 is provided at the high-pressure part 36, and an exit 42*b* thereof is provided at the low-pressure part 37. The bypass flow channel 42 connects the entrance 42*a* thereof substantially linearly to the exit 42*b* thereof in longitudinal sectional view, and an intermediate part of the bypass flow channel 42 is provided along the inside of the fillet portion 14 (on the serpentine flow channel side).

In a third modified example illustrated in FIG. 4B, the high-pressure part 36 is provided on the outer side in the radial direction from the fillet portion 14 inside of the first cooling flow channel 25, and the low-pressure part 37 is provided on the inner side in the radial direction from the fillet portion 14 inside of the second cooling flow channel 26. Then, an entrance 43*a* of a bypass flow channel 43 is provided at the high-pressure part 36, and an exit 43*b* thereof is provided at the low-pressure part 37. Further, similarly to the second modified example, the bypass flow channel 43 connects the entrance 43*a* thereof substantially linearly to the exit 43*b* thereof in longitudinal sectional view, and an intermediate part of the bypass flow channel 43 is provided along the inside of the fillet portion 14.

A fourth modified example illustrated in FIG. 4C is the same as the first example in the definition of the high-pressure part 36, but is different from the first example in that the low-pressure part 37 is provided near the fillet portion 14 inside of the third cooling flow channel 27. If the low-pressure part 37 is provided near the fillet portion 14 inside of the third cooling flow channel 27, the cooling air can be caused to flow into a bypass flow channel 44 by utilizing a difference in pressure between a portion near the fillet portion 14 inside of the fourth cooling flow channel 28 and a portion near the fillet portion 14 inside of the third cooling flow channel 27. In addition, an exit 44*b* of the bypass flow channel 44 is provided in the fillet portion 14 on the downstream side of the third cooling flow channel 27, and an intermediate part of the bypass flow channel 44 is provided along the inside of the fillet portion 14, whereby the bypass flow channel length can be made longer than that of the first modified example, leading to a further increase in the cooling length of the fillet portion 14.

SECOND EXAMPLE

Figure 5A:
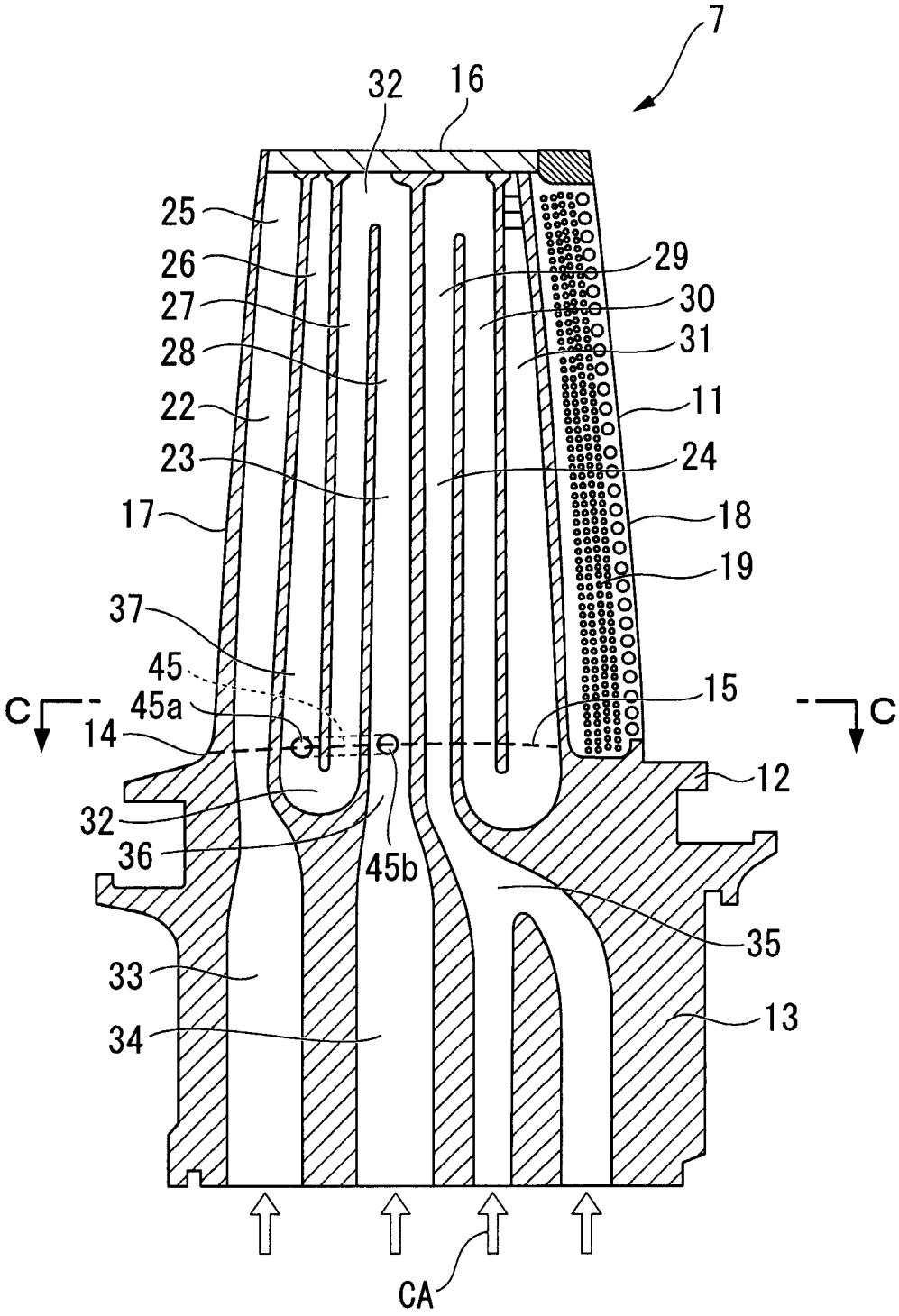
FIG. 5A illustrates a longitudinal sectional view of a turbine blade according to a second example.
Figure 5B:
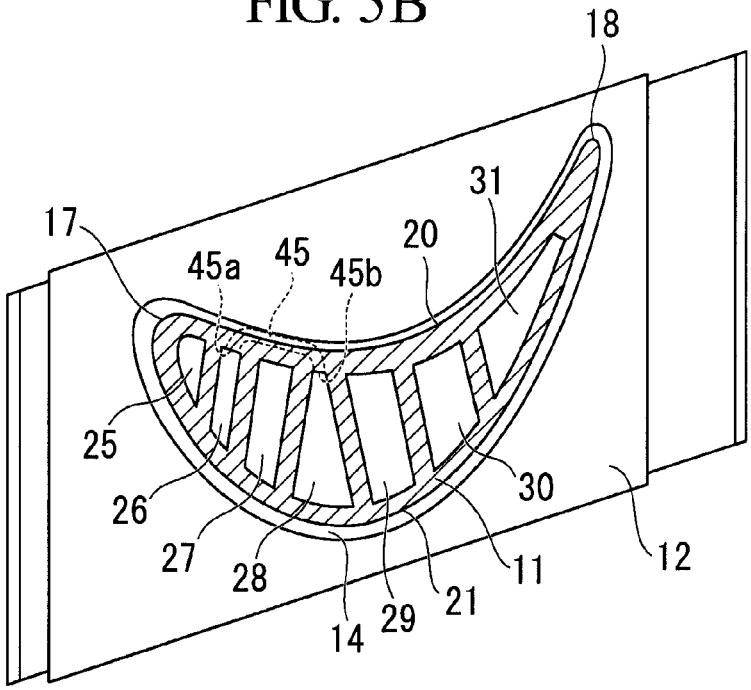
FIG. 5B illustrates a transverse sectional view (a cross-section C-C of FIG. 5A) of the turbine blade.
Figure 5C:
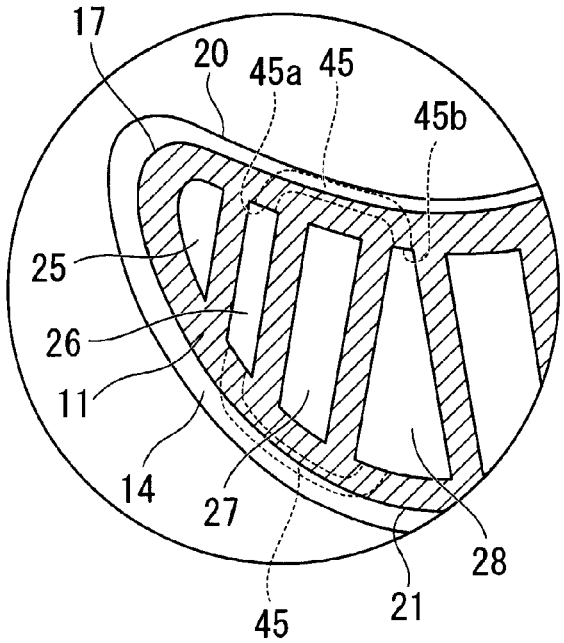
FIG. 5C illustrates a fifth modified example of the bypass flow channel.

Next, with reference to FIG. 5A, FIG. 5B, and FIG. 5C, a second example is described below. The present example is different from the first example in that the present example relates to a bypass flow channel 45 within the second-system flow channel 23, whereas the first example relates to the bypass flow channel between different systems, that is, the first-system flow channel 22 and the second-system flow channel 23. That is, in the present example, the high-pressure part 36 is provided in the fillet portion 14 on the upstream side of the fourth cooling flow channel 28, and the low-pressure part 37 is provided in the fillet portion 14 on the upstream side of the second cooling flow channel 26. The configuration of the present example can produce an effect similar to that of the first example.

Note that, similarly to the first example, the bypass flow channel 45 of the present example may be provided in one of the negative pressure side 21 (suction side) and the positive pressure side 20 (pressure side) of the blade body 11, or may be provided in both the sides. It is desirable to select one side or both the sides, depending on the blade structure and how a thermal load is put on the blade surfaces. In an example illustrated in FIG. 5B, the bypass flow channel 45 is provided only in the positive pressure side 20 of the blade body 11, but the bypass flow channel 45 may be provided only in the negative pressure side 21, depending on the state of a thermal stress. In an example illustrated in FIG. 5C, the bypass flow channel 45 is provided in both the positive pressure side 20 and the negative pressure side 21. In addition, the same concept of the fillet portion 14 and the same relation between the fillet portion and the bypass flow channel as those of the first example can be applied to the present example. Further, the concepts of the modified examples concerning the bypass flow channels illustrated in FIG. 4A and FIG. 4B can be applied to the present example.

THIRD EXAMPLE

Figure 6A:
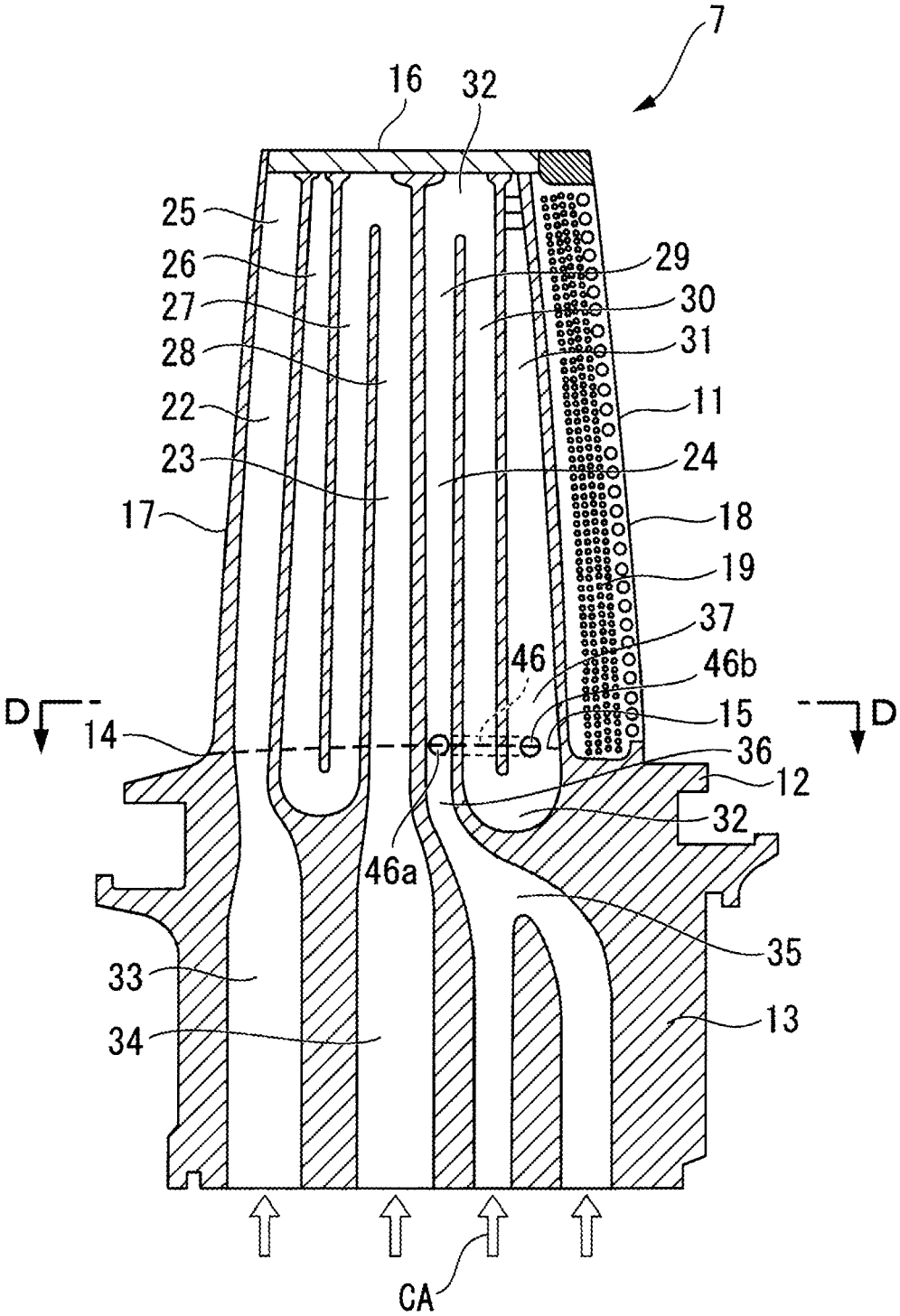
FIG. 6A illustrates a longitudinal sectional view of a turbine blade according to a third example.
Figure 6B:
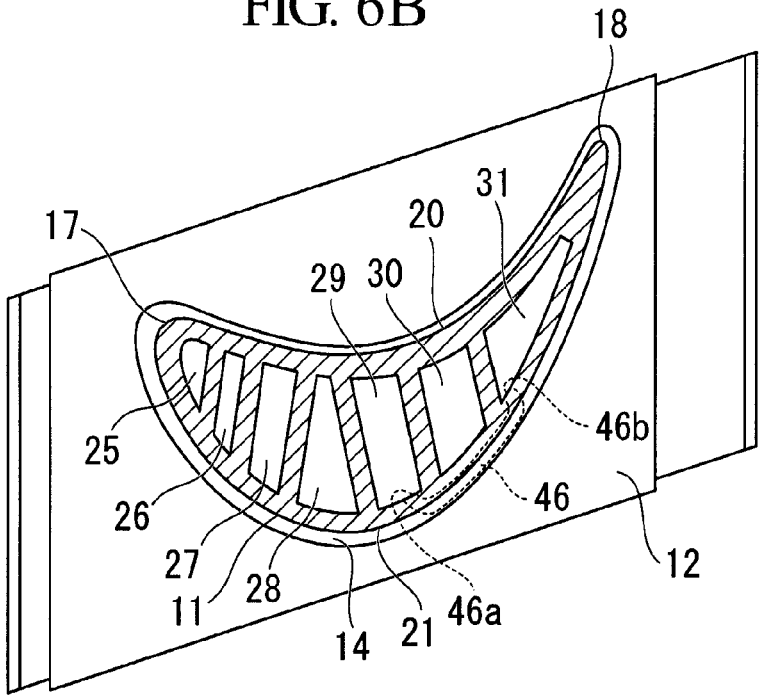
FIG. 6B illustrates a transverse sectional view (a cross-section D-D of FIG. 6A) of the turbine blade.
Figure 6C:
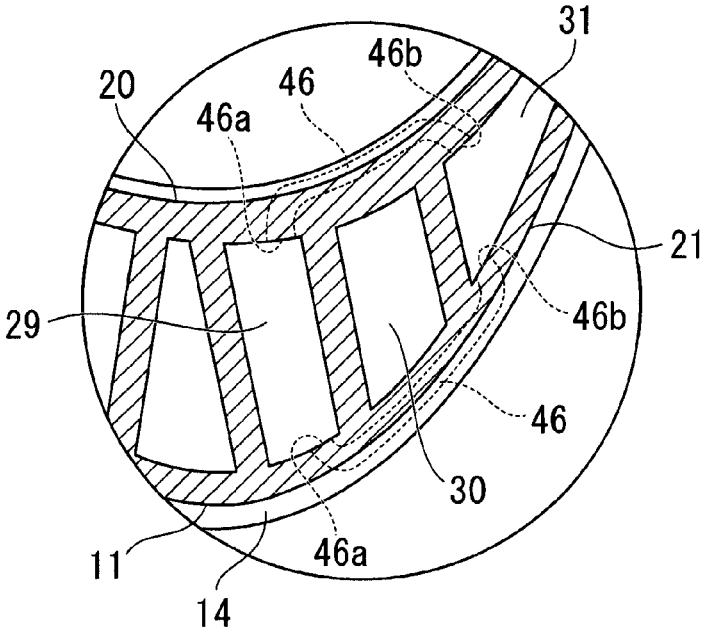
FIG. 6C illustrates a sixth modified example of the bypass flow channel.

Next, with reference to FIG. 6A, FIG. 6B, and FIG. 6C, a third example is described below. The present example is different from the first example and the second example in that the present example relates to a bypass flow channel 46 within the third-system flow channel 24. That is, the third-system flow channel 24 is formed of a long meandering serpentine cooling flow channel configured by connecting the fifth cooling flow channel 29, the sixth cooling flow channel 30, and the seventh cooling flow channel 31 in the stated order from the leading edge 17 to the trailing edge 18 through the fold-back structures (return portions), the fifth cooling flow channel 29 being located closest to the fourth cooling flow channel 28. The pressure of the cooling air CA is highest at the entrance of the fifth cooling flow channel 29, the entrance taking in the cooling air from the rotor 5 side. Similarly to the second-system flow channel, the cooling air pressure gradually decreases due to pressure loss while the cooling air CA flows through the cooling flow channel, and the cooling air pressure becomes substantially the same as the combustion gas pressure immediately after the cooling air, which has flown from the seventh cooling flow channel 31 toward the trailing edge 18, is discharged from the trailing edge end part 19 into the combustion gas. That is, the cooling air pressure gradually decreases while the cooling air CA flows through the fifth cooling flow channel 29, the sixth cooling flow channel 30, and the seventh cooling flow channel 31 in the stated order. A high-pressure part 36 having a high pressure is formed near the fillet portion 14 inside of the flow channel for the cooling air CA entering the blade body 11 from the base portion 13 side of the fifth cooling flow channel 29, and a low-pressure part 37 having a low pressure is formed near the fillet portion 14 on the upstream side of the seventh cooling flow channel 31. Accordingly, a difference in pressure between the fifth cooling flow channel 29 and the seventh cooling flow channel 31 may be utilized, and the bypass flow channel 46 may be provided therebetween so as to run along the fillet portion 14. The configuration of the present example can produce an effect similar to that of the first example.

Note that, also in the present example, whether the bypass flow channel 46 is provided in any of the negative pressure side 21 and the positive pressure side 20 of the blade body 11 or in both the sides is selected depending on the blade structure and how a thermal load is put on the blade surfaces, similarly to the first example. In an example illustrated in FIG. 6B, the bypass flow channel 46 is provided only in the negative pressure side 21 of the blade body 11, but the bypass flow channel 46 may be provided only in the positive pressure side 20, depending on the state of a thermal stress. In an example illustrated in FIG. 6C, the bypass flow channel 46 is provided in both the positive pressure side and the negative pressure side. Further, the same concept of the fillet portion 14 and the same relation between the fillet portion and the bypass flow channel as those of the first example can be applied to the present example. Furthermore, similarly to the second example, the concepts of the modified examples concerning the bypass flow channels illustrated in FIG. 4A and FIG. 4B can be applied to the present example.

Note that the configurations described above in the first example to the third example may be independently adopted for each example or may be adopted in combination, depending on the blade structure and how a thermal load is put on the blade surfaces. Further, an effect similar to that of the first example can be obtained by adopting some of the above-mentioned examples in combination.

In addition, according to the first example, the serpentine flow channels in three flow systems are provided, the first-system flow channel 22 located closest to the leading edge 17 is configured as a single cooling flow channel, and the second-system flow channel 23 and the third-system flow channel 24 are each configured as a serpentine cooling flow channel formed by connecting in series three cooling flow channels to one another from the leading edge 17 toward the trailing edge 18. A similar concept can be applied to configurations of other cooling flow channels.

In the cooling flow channel according to the first example, the first-system flow channel is configured as a single flow channel, and the second-system flow channel and the third-system flow channel are each configured as three serpentine cooling flow channels. That is, the cooling flow channel according to the first example is configured using seven cooling flow channels as a whole (this configuration is referred to as 1-3U-3D system). Here, the "1-3U-3D system" means that flow channels in three flow systems are provided and that the second-system flow channel and the third flow channel are each configured using three flow channels. Further, the flow channel through which the cooling air CA flows from the leading edge 17 toward the trailing edge 18 is represented by "D", and the flow channel through which the cooling air CA flows in the opposite direction is represented by "U", whereby the two flow channels are distinguished from each other.

Another flow channel configuration (1-5D-1 system) is described as an example. This system is configured using seven flow channels as a whole, similarly to the first example. The first-system flow channel is configured as a single flow channel, the second-system flow channel is configured as a serpentine flow channel including five flow channels, and the third-system flow channel is configured as a single cooling flow channel. In the second-system flow channel, the cooling air flows from the leading edge 17 toward the trailing edge 18. In such a system, assuming that a flow channel number is given to each flow channel in order from the leading edge 17 to the trailing edge 18 similarly to the first example, the following configuration is established. That is, a bypass flow channel is provided between the first cooling flow channel and the third cooling flow channel, between the first cooling flow channel and the fourth cooling flow channel, or between the first cooling flow channel and the fifth cooling flow channel, and the bypass flow channel is provided along the inside of the fillet portion 14.

There are a wide variety of configurations for the cooling flow channel in the turbine blade, depending on the concept of cooling design of the blade, but a configuration that can satisfy the technical idea of the present invention can be achieved in the following manner. That is, a flow channel having the highest pressure among cooling flow channels in a given system is defined as the high-pressure part, and a flow channel having the lowest pressure among the flow channels in the given system or flow channels in a different system is defined as the low-pressure part. Then, a bypass flow channel is provided between the high-pressure part and the low-pressure part near the fillet portion. It is not advisable to define the high-pressure part and the low-pressure part at positions far from the fillet portion, because such definition causes difficulty in providing the bypass flow channel therebetween upon actual manufacturing. Note that description is given above by taking as an example the high-pressure part having the highest pressure and the low-pressure part having the lowest pressure, but the bypass flow channel can be provided even at a part having an intermediate pressure as long as a difference in pressure that is large enough to allow the cooling air to flow between the high-pressure part and the low-pressure part can be ensured.

The examples described above are given as representative examples reflecting the technical idea of the present invention, and other examples and modified examples can fall within the scope of the technical idea of the present invention as long as those examples satisfy the technical idea of the present invention.

REFERENCE SIGNS LIST

1 gas turbine
2 compressor
3 combustor
4 turbine unit
5 rotor
6 turbine vane
7 turbine blade
11 blade body
11*a* outer wall surface of blade body
12 platform
12*a* platform outer surface
13 base portion
14 fillet portion
14*a* fillet upper end line
14*b* fillet lower end line
16 blade top portion
17 leading edge
18 trailing edge
19 trailing edge end part
20 positive pressure side (pressure side)
21 negative pressure side (suction side)
22 first-system flow channel
23 second-system flow channel
24 third-system flow channel
25 first cooling flow channel
26 second cooling flow channel
27 third cooling flow channel
28 fourth cooling flow channel
29 fifth cooling flow channel
30 sixth cooling flow channel
31 seventh cooling flow channel
32 return portion
33 first supply flow channel
34 second supply flow channel
35 third supply flow channel
36 high-pressure part
37 low-pressure part
41, 42, 43, 44, 45, 46 bypass flow channel
41*a*, 42*a*, 43*a*, 44*a*, 45*a*, 46*a* entrance
41*b*, 42*b*, 43*b*, 44*b*, 45*b*, 46*b* exit
CA cooling air

The invention claimed is:

1. A turbine blade comprising:

a platform;

a blade body including at least one cooling flow channel including a meandering serpentine cooling flow channel;

a fillet portion provided in a joint surface between the blade body and the platform; and a base portion including a supply flow channel communicating with the cooling flow channel of the blade body, wherein a bypass flow channel is branched off from a high-pressure part of the cooling flow channel and is connected to a low-pressure part of the cooling flow channel, wherein the bypass flow channel is provided so as to run along the fillet portion in a rotor axis direction, wherein the bypass flow channel is formed in a wall of the blade body in sectional view when the blade body is seen from a leading edge toward a trailing edge of the turbine blade, and wherein a portion of the wall of the blade body in which the bypass flow channel is formed is surrounded by a fillet upper end line and a fillet lower end line, the fillet upper end line defining a boundary between an outer wall surface of the blade body and the fillet portion, and the fillet lower end line defining a boundary between a platform outer surface and the fillet portion.

2. The turbine blade according to claim 1, wherein the bypass flow channel has an entrance and an exit both of which are provided in a portion of the fillet portion.

3. The turbine blade according to claim 1, wherein the bypass flow channel has an entrance provided on an inner side in a radial direction from a portion of the fillet portion and an exit provided on an outer side in the radial direction from the portion of the fillet portion.

4. The turbine blade according to claim 1, wherein the bypass flow channel has an entrance provided on an outer side in a radial direction from a portion of the fillet portion and an exit provided on an inner side in the radial direction from the portion of the fillet portion.

5. The turbine blade according to claim 1, wherein the at least one cooling flow channel includes cooling flow channels in a plurality of systems, and the high-pressure part and the low-pressure part are provided in cooling flow channels in different systems.

6. The turbine blade according to claim 1, wherein the at least one cooling flow channel includes cooling flow channels in a plurality of systems, and the high-pressure part and the low-pressure part are provided in a cooling flow channel in the same system.

7. The turbine blade according to claim 1, wherein the bypass flow channel is provided in at least one of a pressure side and a suction side of the blade body.

8. The turbine blade according to claim 1, wherein the cooling flow channel of the blade body includes cooling flow channels in three systems, a first-system cooling flow channel is formed of a first cooling flow channel, which is located at a most leading edge side, a second-system cooling flow channel is formed of a serpentine cooling flow channel including a second cooling flow channel, a third cooling flow channel, and a fourth cooling flow channel that are arranged in the stated order from the leading edge toward a trailing edge, the second cooling flow channel being located adjacent to the first cooling flow channel, a third-system cooling flow channel is formed of a serpentine cooling flow channel including a fifth cooling flow channel, a sixth cooling flow channel, and a seventh cooling flow channel that are arranged in the stated order from the leading edge toward the trailing edge, the fifth cooling flow channel being adjacent to the fourth cooling flow channel, the high-pressure part is provided in the first cooling flow channel, and the low-pressure part is provided in the second cooling flow channel.

9. A gas turbine comprising the turbine blade according to claim 1.

* * * * *